US010619550B2

(12) United States Patent
Perr

(10) Patent No.: US 10,619,550 B2
(45) Date of Patent: Apr. 14, 2020

(54) MAIN BEARING CAP STUD CONFIGURATION AND ASSEMBLY METHOD

(71) Applicant: CUMMINS INC., Columbus, IN (US)

(72) Inventor: Andrew P. Perr, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/101,233

(22) Filed: Aug. 10, 2018

(65) Prior Publication Data

US 2020/0049193 A1 Feb. 13, 2020

(51) Int. Cl.
*F02F 7/00* (2006.01)
*F01P 3/12* (2006.01)

(52) U.S. Cl.
CPC ..... *F01P 3/12* (2013.01)

(58) Field of Classification Search
CPC ..... F02F 3/22; F02F 7/0046; F01P 2003/006; F01P 9/00
See application file for complete search history.

(56) References Cited

U.S. PATENT DOCUMENTS

| | | | | |
|---|---|---|---|---|
| 4,510,894 | A * | 4/1985 | Williams | F02B 75/26 123/48 AA |
| 4,644,911 | A | 2/1987 | Hidaka et al. | |
| 5,357,922 | A | 10/1994 | Han | |
| 5,623,894 | A * | 4/1997 | Clarke | F02B 25/08 123/50 R |
| 5,901,679 | A | 5/1999 | Tanaka et al. | |
| 6,543,405 | B2 | 4/2003 | Sachdev et al. | |
| 7,284,528 | B2 * | 10/2007 | Natkin | F02F 7/0053 123/195 A |
| 2010/0024763 | A1 * | 2/2010 | Sparling | F02B 57/06 123/200 |
| 2012/0031366 | A1 * | 2/2012 | Dunlavey | F02F 7/0053 123/195 H |
| 2012/0204841 | A1 * | 8/2012 | Hofbauer | F16C 7/023 123/51 BA |

FOREIGN PATENT DOCUMENTS

| | | |
|---|---|---|
| CN | 10-3065690 | 4/2013 |
| WO | 2014/165045 | 3/2014 |

* cited by examiner

*Primary Examiner* — Long T Tran
(74) *Attorney, Agent, or Firm* — Faegre Drinker Biddle & Reath LLP

(57) ABSTRACT

The present disclosure provides a stud assembly insertable throughout a base block. The stud assembly includes a retention ring to engage with the base block and provide ease in assembly of the bearing cap stud assembly in an engine configuration without compromising load carrying characteristics of the design.

9 Claims, 9 Drawing Sheets

MAIN BEARING CAP STUD CONFIGURATION AND ASSEMBLY METHOD

TECHNICAL FIELD OF THE PRESENT DISCLOSURE

The present disclosure generally relates to a main bearing cap and stud configuration and assembly, and more particularly, to a main bearing cap and stud configuration and assembly method for an internal combustion engine.

BACKGROUND OF THE PRESENT DISCLOSURE

In the past, when assembling an engine assembly, a full length cross stud with an installed fixed head or nut needed enough clearance next to a base block to install or retract the entire length of the stud from within the base block, and fixtures were needed to hold the first crankshaft in place during installation and torquing of the second crankshaft and main bearing cap nuts. This would result in limitations to orientation and access to service the engine and would likely require removal of the entire engine package from the vehicle.

Improvements in the foregoing are desired.

SUMMARY OF THE PRESENT DISCLOSURE

The present disclosure provides a stud assembly insertable throughout a base block. The stud assembly includes a retention ring to engage with the base block and provide ease in assembly of the bearing cap stud assembly in an engine configuration without compromising load carrying characteristics of the design.

In one embodiment of the present disclosure, an engine assembly is provided. The engine assembly includes: a base block including a first cavity configured to receive a first crankshaft and a second cavity configured to receive a second crankshaft; a stud assembly receivable through the base block, the stud assembly including: a sleeve encircling the stud assembly, the sleeve configured to create a cooling annulus for the stud assembly; and a first ring encircling the stud assembly, the first ring configured to retain the stud assembly onto the base block by engaging with a groove in the base block.

In another embodiment of the present disclosure, the engine assembly further includes a second ring coupling the sleeve onto the stud assembly. In a further embodiment of the present disclosure, the engine assembly further includes a first bearing cap coupled to a first end of the stud assembly and a second bearing cap coupled to a second end of the stud assembly. In another embodiment of the present disclosure, the engine assembly further includes a first nut coupling the first bearing cap to the stud assembly and a second nut coupling the second bearing cap to the stud assembly. In a further embodiment, the first nut and the second nut undergo torquing to couple the first bearing cap and the second bearing cap to the stud assembly. In a further embodiment of the present disclosure, the base block receives a first connecting rod and a first piston coupled to the first crankshaft and a second connecting rod and a second piston coupled to the second crankshaft. In a further embodiment, the stud assembly includes a first end and a second end, the first end and second end having a hexagonal shape and configured to couple to a first bearing cap and a second bearing cap, respectively. In a further embodiment of the present disclosure, the cooling annulus is formed within the base block when the stud assembly is inserted into the base block, the cooling annulus configured to allow coolant flow therethrough. In a further embodiment of the present disclosure, the first piston and the second piston are in an opposed configuration.

In another embodiment of the present disclosure, a method of assembling a bearing cap stud configuration is provided. The method includes installing a first stud assembly and a second stud assembly within the base block; coupling a first bearing cap onto a first end of the first stud assembly and a first end of the second stud assembly; coupling a second bearing cap onto a second end of the first stud assembly and a second end of the second stud assembly; partially torqueing the first bearing cap onto the first ends of the first and second stud assemblies; fully torqueing the second bearing cap onto the second ends of the first and second stud assemblies; and fully torqueing the first bearing cap onto the first ends of the first and second stud assemblies.

In another embodiment of the present disclosure, the first and second stud assemblies include a first ring encircling the stud assembly, the first ring configured to retain the stud assembly onto the base block by engaging with a groove in the base block. In a further embodiment of the present disclosure, the method further includes: inserting a first engine piston and a second engine piston within the base block; inserting a first connecting rod within the base block and coupling the first connecting rod to the first engine piston; inserting a second connecting rod within the base block and coupling the second connecting rod to the second engine cylinder; inserting a first crankshaft within a first recess of the base block; and inserting a second crankshaft within a second recess of the base block. In another embodiment of the present disclosure, the first bearing cap cooperates with the first stud assembly and the second stud assembly to hold the first engine piston, first connecting rod, and first crankshaft; and the second bearing cap cooperates with the first stud assembly and the second stud assembly to hold the second engine piston, second connecting rod, and second crankshaft.

In a further embodiment of the present disclosure, the first and second engine pistons are in an opposed configuration. In another embodiment of the present disclosure, the first and second stud assemblies include a first ring encircling the stud assembly, the first ring configured to retain the stud assembly onto the base block by engaging with a groove in the base block. In another embodiment of the present disclosure, the method further includes a second ring coupling the sleeve onto the stud assembly. In another embodiment of the present disclosure, an annular passage is formed within the base block when the stud assembly is inserted into the base block, the annular passage configured to allow coolant flow therethrough. In a further embodiment of the present disclosure, the method further includes coupling a first nut onto the first bearing cap and a second nut onto the second bearing cap. In a further embodiment, partially torqueing the first bearing cap onto the first ends of the first and second stud assemblies includes partially torquing the first nut; fully torqueing the second bearing cap onto the second ends of the first and second stud assemblies includes fully torqueing the second nut; and fully torqueing the first bearing cap onto the first ends of the first and second stud assemblies includes fully torqueing the first nut. In a further embodiment, the first end and the second end of the stud assembly have a hexagonal shape and are configured to couple to the first bearing cap and the second bearing cap, respectively.

DETAILED DESCRIPTION OF THE DRAWINGS

The present disclosure provides a stud assembly insertable throughout a base block. The stud assembly includes a retention ring to engage with the base block and provide ease in assembly of the bearing cap stud assembly in an engine configuration without compromising load carrying characteristics of the design.

Figure 1:
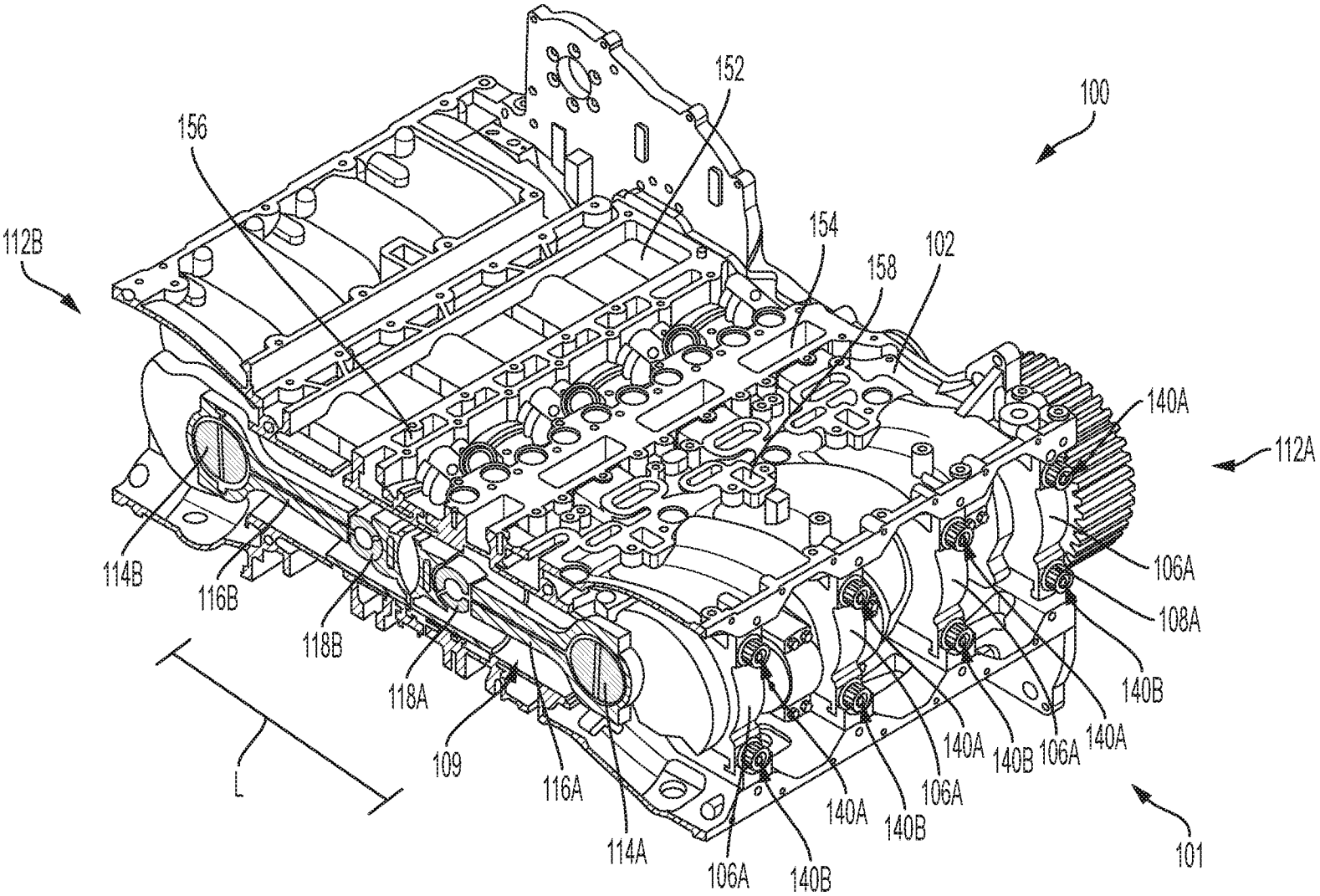
FIG. 1 is sectional, perspective view of an assembled engine assembly with bearing cap stud assembly having engine components.
Figure 2:
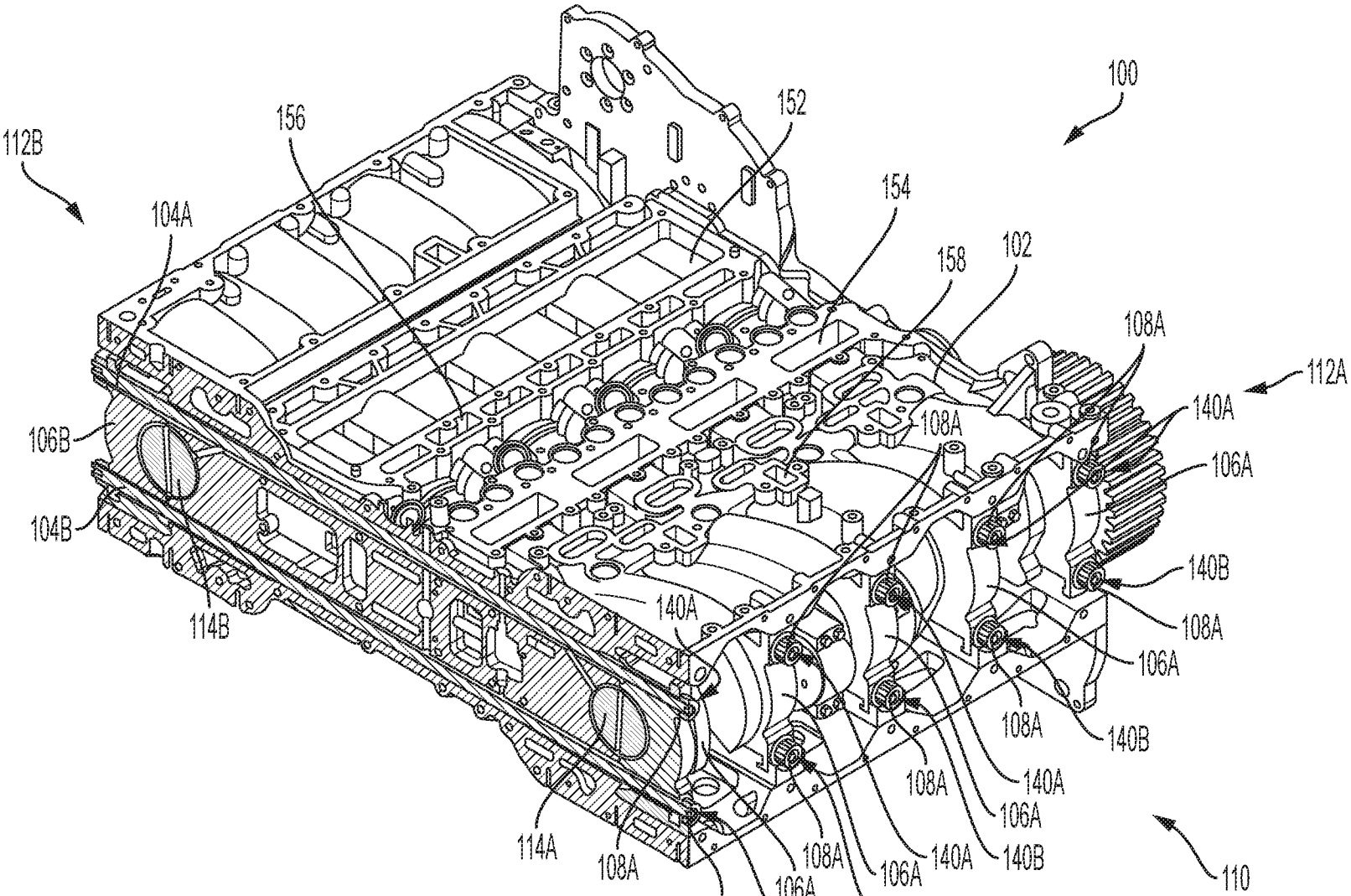
FIG. 2 is a sectional perspective view of the engine assembly of FIG. 1 illustrating the configuration of stud assemblies and bearing caps of the bearing cap stud assembly to retain the engine configuration.
Figure 3:
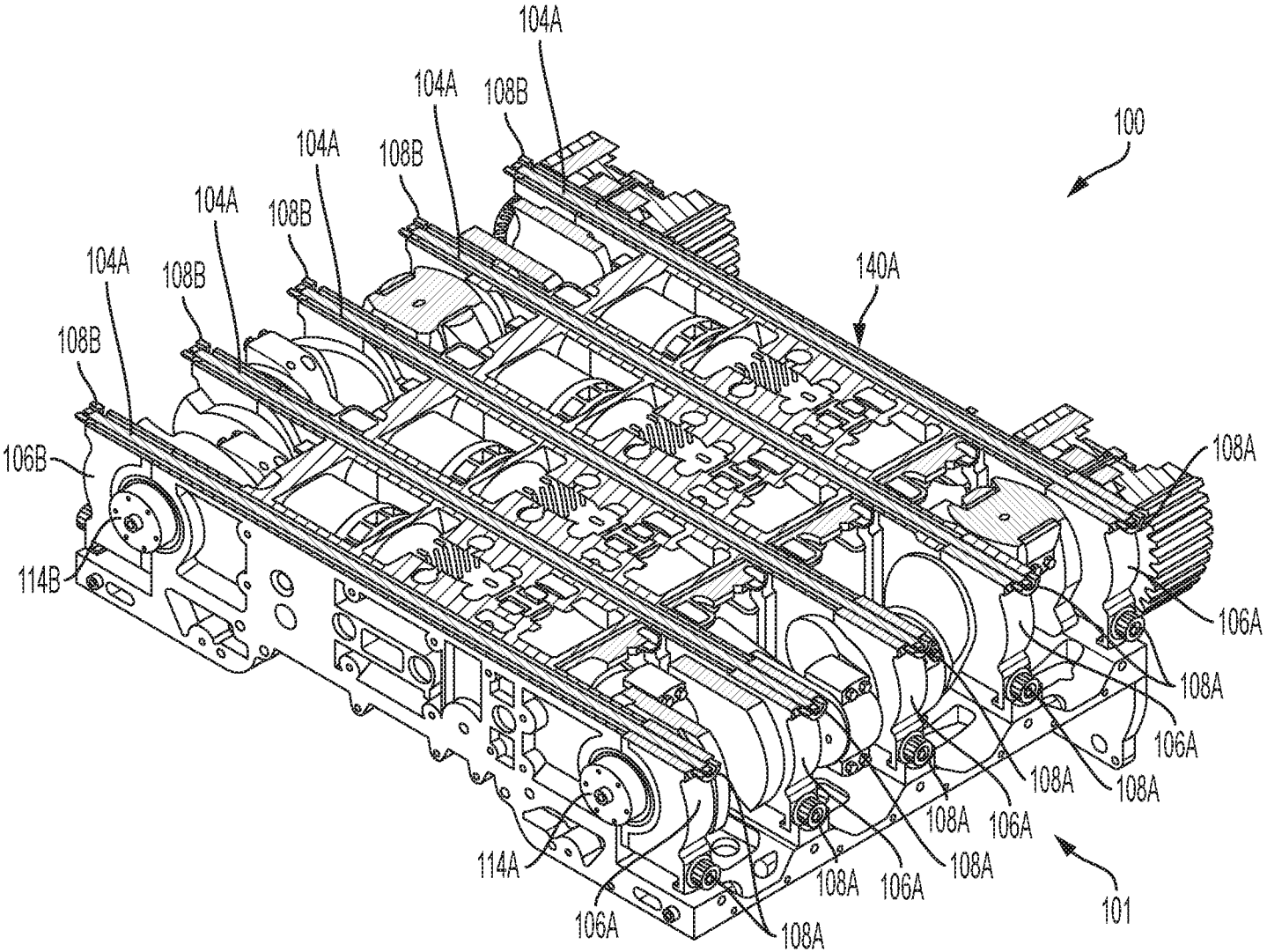
FIG. 3 is another sectional perspective view of the engine assembly of FIG. 1 illustrating the configuration for the bearing caps and some of the stud assemblies of the bearing cap stud assembly shown in FIG. 2.
Figure 4:
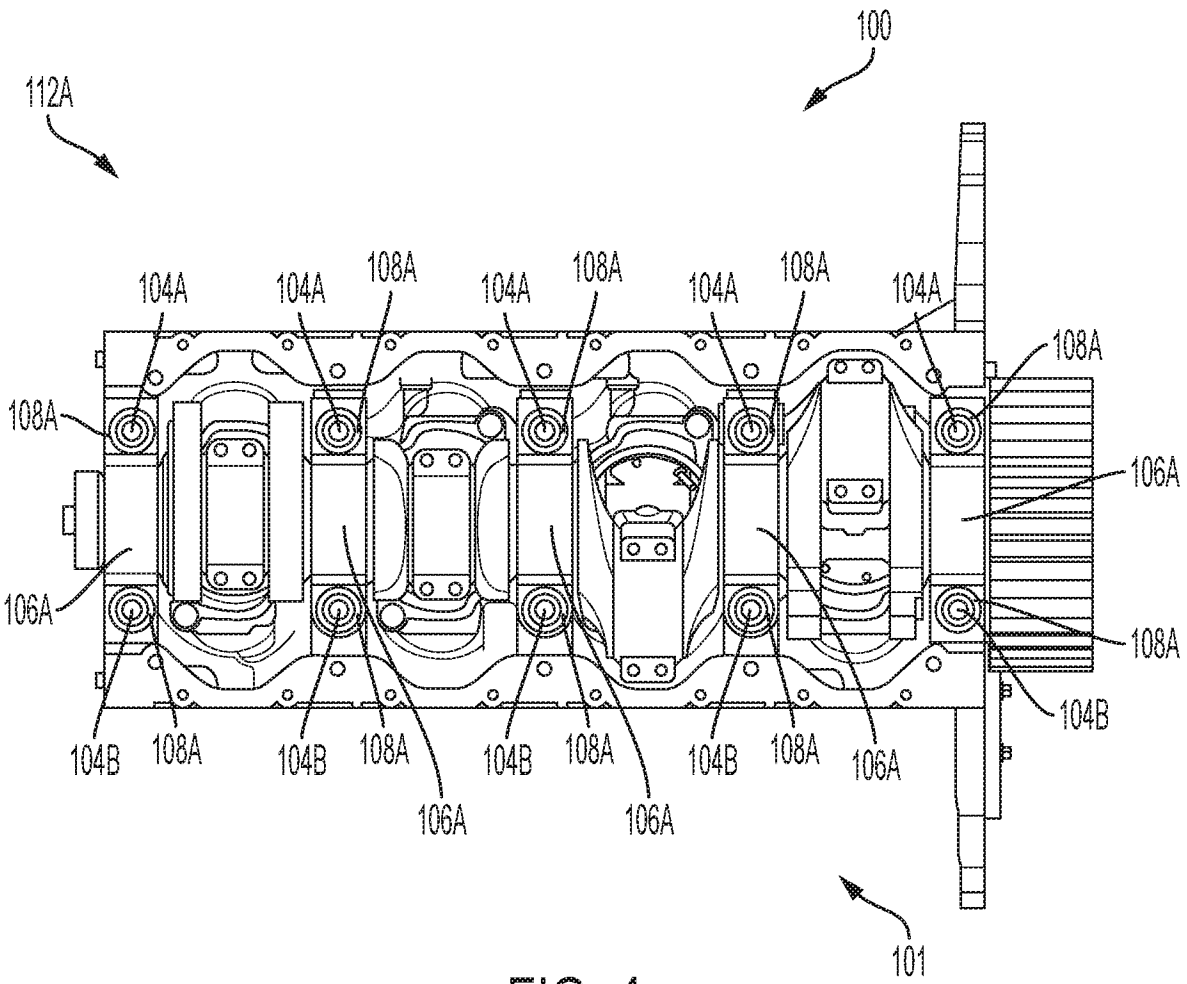
FIG. 4 is a side view of the bearing cap stud assembly within the engine assembly of FIG. 1.

Referring first to FIGS. 1-5, an engine assembly 100 is provided. Engine assembly 100 includes a base block or cylinder block 102 which includes cavities 112A, 112B configured to receive crankshafts 114A, 114B, connecting rods 116A, 116B, and engine pistons 118A, 118B as shown in FIGS. 1-3. Cavities 112A, 112B are connected to each other by a passage 109 which receives and contains engine pistons 118A, 118B and connecting rods 116A, 116B while crankshafts 114A, 114B are seated in cavities 112A, 112B, respectively in the assembled configuration. As shown in FIG. 3, base block 102 is configured for a four cylinder engine. However, it is contemplated that in alternate embodiments, alternate engine configurations may be used such as a 6 cylinder engine, for example. Furthermore, as shown in FIG. 4, base block 102 of assembly 100 is configured for an opposed piston internal combustion engine. However, it is contemplated that in alternate embodiments, alternate engine cylinder configurations may be used such as inline or V-configuration.

Base block 102 is a single piece casting made from alloyed grey iron. However, it is contemplated that in alternate embodiments, base block 102 can be made from other materials depending on structural design standards, for example, lightweight aluminum, compacted graphite iron (CGI) or the like. Base block 102 features integrated cylinder bores and port details cast into base block 102 itself, but may also be configured with separate cylinder bore liners and ports that install within block 102. Base block 102 further includes intake plenum flanges 152 and exhaust plenum flanges 154 for use during operation of the engine (not shown). Intake plenums with flanges 152 and exhaust plenums with flanges 154 are present on both the upper and lower sides of block 102 to enable engine breathing from both sides of base block 102. The full length, cross-loaded stud arrangement allows increased flexibility to the plenum designs to improve engine breathing, while maintaining structure integrity. Base block 102 also includes coolant passages 156 and oil or coolant passages 158 that are integrally formed with base block 102, which function to maintain engine assembly 100 at an appropriate temperature and to send lubricant to moving parts. The drillings in block 102 accommodate the full-length, cross-loaded stud arrangement and help distribute the lubricating oil throughout the engine.

Base block 102 further includes passages 140A, 140B configured to receive stud assemblies 104 as further described herein. As shown in at least FIGS. 2 and 3, passages 140A, 140B extend throughout length L of base block 102 such that a portion of stud assembly 104 protrudes into both cavity 112A and 112B.

Figure 5:
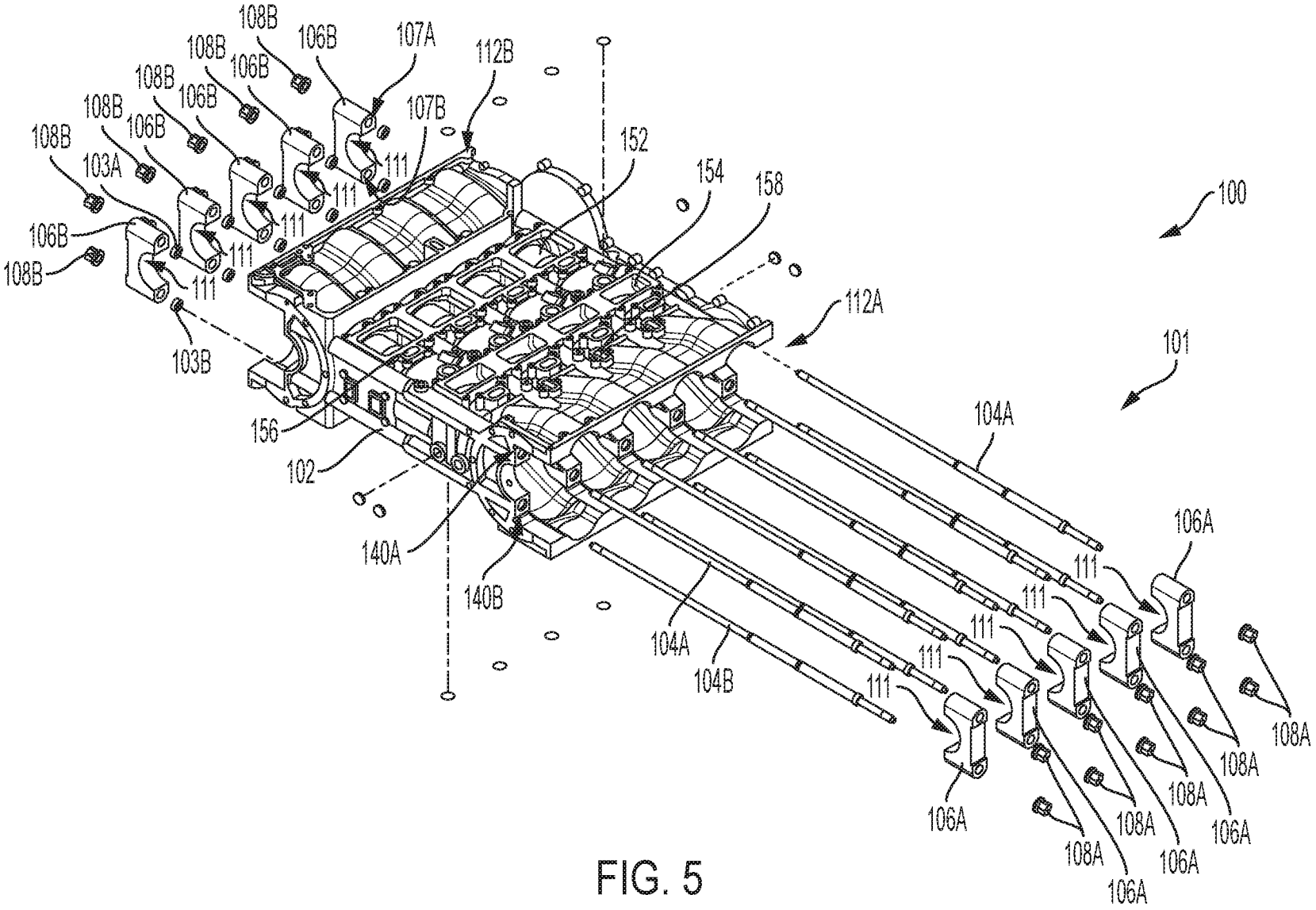
FIG. 5 is an exploded, perspective view of the engine assembly of FIG. 1 with the bearing cap stud assembly of FIG. 1.
Figure 9:
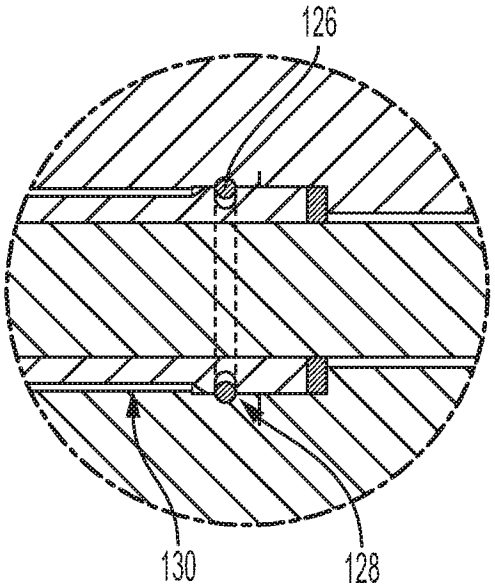
FIG. 9 is an expanded view of another portion of the stud assembly as inserted in the base block of FIG. 7 illustrating the retention mechanism for the stud assembly.
Figure 7:
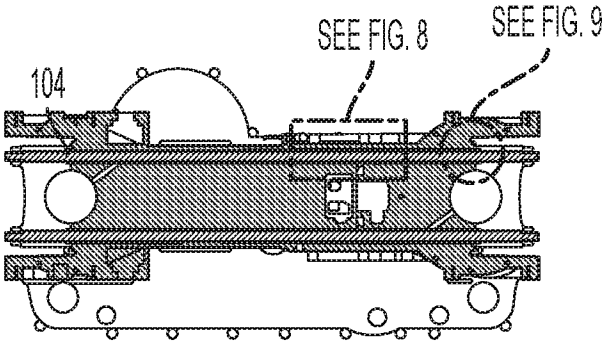
FIG. 7 is a cross-sectional view of the base block of FIG. 5 with the stud assembly of FIG. 6 installed.
Figure 6:
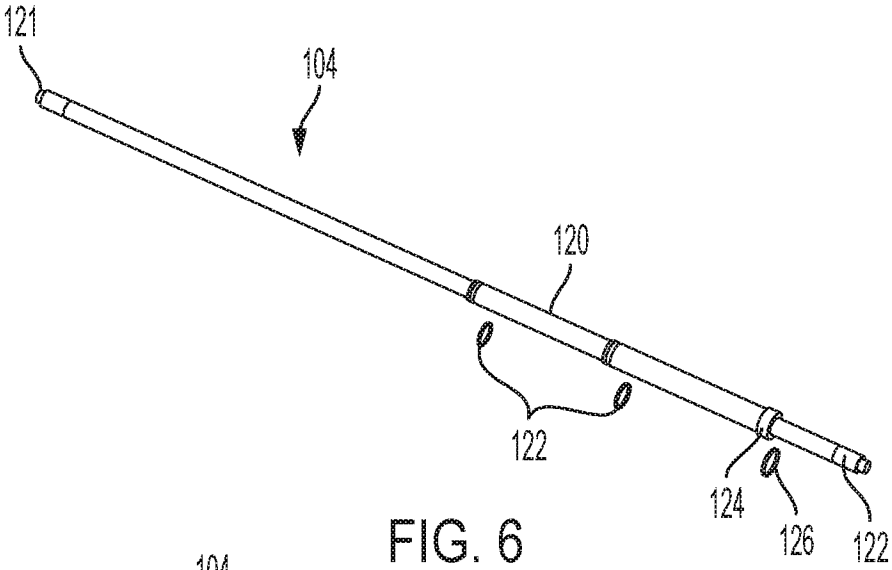
FIG. 6 is a perspective view of a stud assembly of the bearing cap stud assembly shown in FIG. 5.
Figure 8:
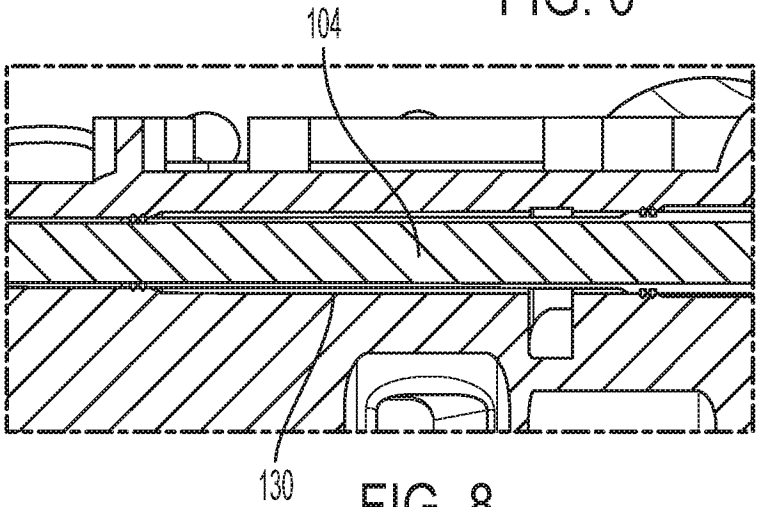
FIG. 8 is an expanded view of a portion of the stud assembly as installed within the base block shown in FIG. 7.

Base block 102 is configured to receive a bearing cap stud assembly 101. Bearing cap stud assembly 101 includes stud assemblies 104A, B coupled to bearing caps 106A, B. Stud assemblies 104 A, B are configured to hold the entire structure of assembly 100 together (base block 102, crankshafts 114A, 114B, connecting rods 116A, 116B, engine pistons 118A, 118B, etc.), and bearing caps 106A, 106B are doweled to base block 102 and configured to hold crankshafts 114A, 114B within cavities 102A, 102B of base block 102. In particular, bearing caps 106A, 106B are contoured to form respective recesses 111A, 111B (FIG. 5) in which crankshafts 114A, 114B are received. When fully installed within base block 102, as described further herein, stud assemblies 104A are received within openings 105A of bearing caps 106A and openings 107A of bearing caps 106B. Similarly, stud assemblies 104B are received within openings 105B of bearing caps 106A and openings 107B of bearing caps 106B. Furthermore, bearing cap nuts 108A, 108B are used to couple stud assemblies 104A, 104B onto bearing caps 106A, 106B as shown in FIG. 5 while dowels 103A, 103B are used to locate bearing caps 106A, 106B to base block 102.

Referring now to FIGS. 6-9, stud assemblies 104A, 104B include a sleeve 120 pressed to position onto the body of stud assemblies 104A, B. In one embodiment, sleeve 120 is pressed onto stud assemblies 104A, B for the entire length of stud assemblies 104A, B. In another embodiment, sleeve 120 is pressed onto a portion of stud assemblies 104 A, B for a portion of stud assemblies 104A, B. Sleeve 120 is configured to create a cooling annular passage 130 (FIG. 8) when stud assemblies 104A, B are installed through passages 140A, B within base block 102. Cooling annular passage 130 cooperates with coolant passage 156 (FIG. 1) and/or oil or coolant passage 158 (FIG. 1) to provide a passageway for coolant to flow therethrough and around sleeve 120 to cool the bosses (e.g., C ring 126 (FIG. 6)) on stud assemblies 104A, 104B that are exposed to hot exhaust flow in exhaust plenum 154. Moreover, sleeve 120 protects stud assemblies 104A, 104B from exposure to coolant subsequent stress corrosion. Stud assemblies 104A, 104B further includes O-rings 122 that provide containment for the coolant that flows around sleeve 120. In addition to sleeve 120, ground sleeve 124 is also provided onto stud assemblies 104A, 104B to locate exhaust side bearing caps 106A or 106B.

Stud assemblies 104A, 104B further include a C-ring 126 that enables retention of stud assemblies 104A, 104B onto base block 102 and within passages 140A, 140B. In particular, passages 140A, 140B include a groove 128 for receiving C-ring 126. That is, stud assemblies 104A, 104B are inserted into respective passages 140A, 140B until C-ring 126 fits within and engages with groove 128. C-ring 126, when engaged with groove 128, holds the weight of bearing cap stud assembly 101 during installation of engine components as described further herein. That is, the engagement of C-ring 126 with groove 128 holds the weight of bearing cap stud assembly 101 and the first installed crankshaft 114A or 114B until the second crankshaft 114A or 114B and second set of corresponding bearing caps 106A or 106B and corresponding nuts 108A or 108B are assembled. In other words, C-ring 126 provides means for retaining bearing cap stud assembly 101 and the first installed crankshaft 114A or 114B within base block 102 for the duration of the partial torquing installation method described herein. In relation to the installation method, stud assemblies 104A, B also include hex features 121, 122 at the ends of stud assemblies 104A, B to allow for a holding tool against counter rotation during the torque installation procedure as described further herein. It is contemplated that in an alternate embodiment, alternate shaped ends for the fastener may be used.

Figure 10:
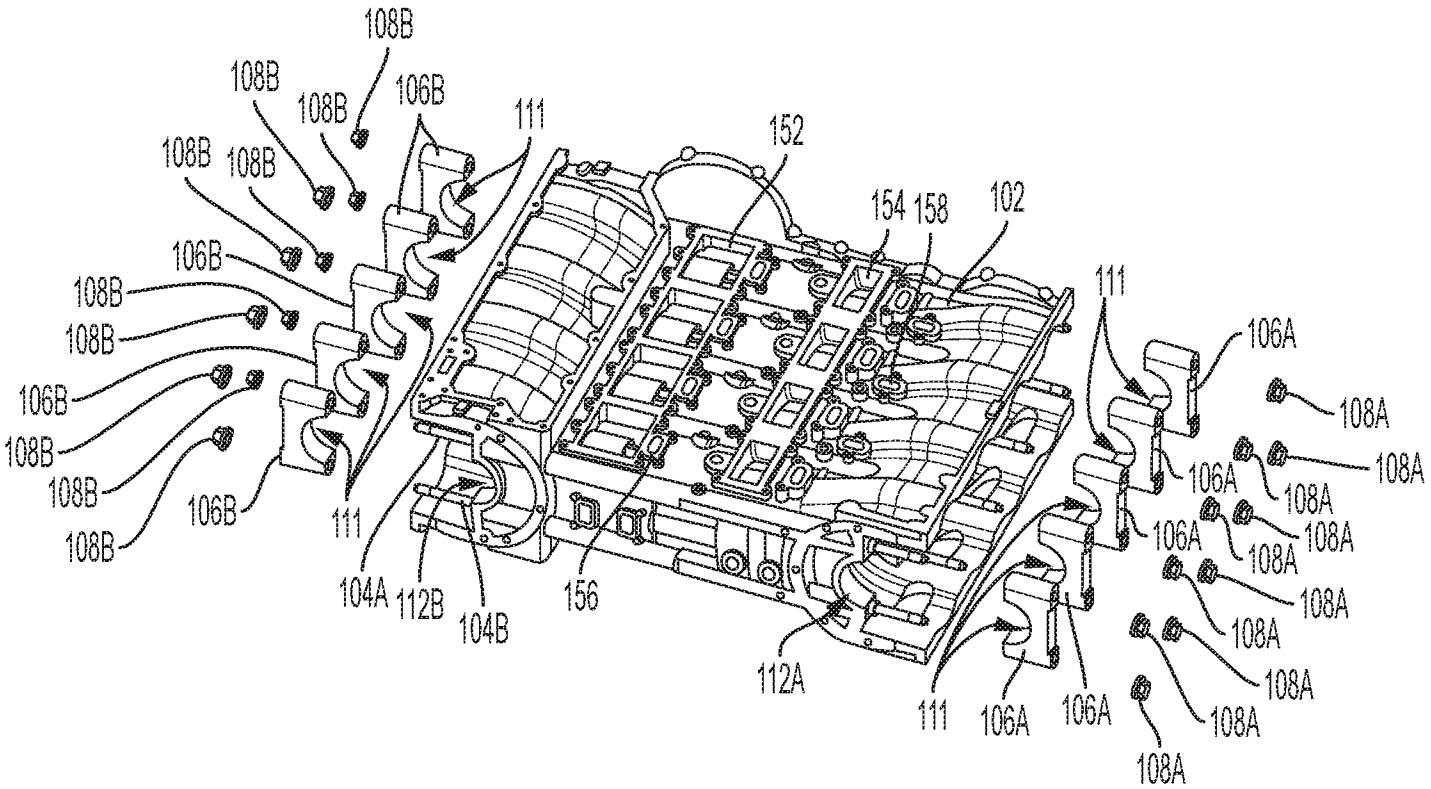
FIG. 10 is a perspective view of the base block of FIG. 5 illustrating a first general step in assembling the bearing stud cap configuration on the base block with the engine cylinders removed.
Figure 11:
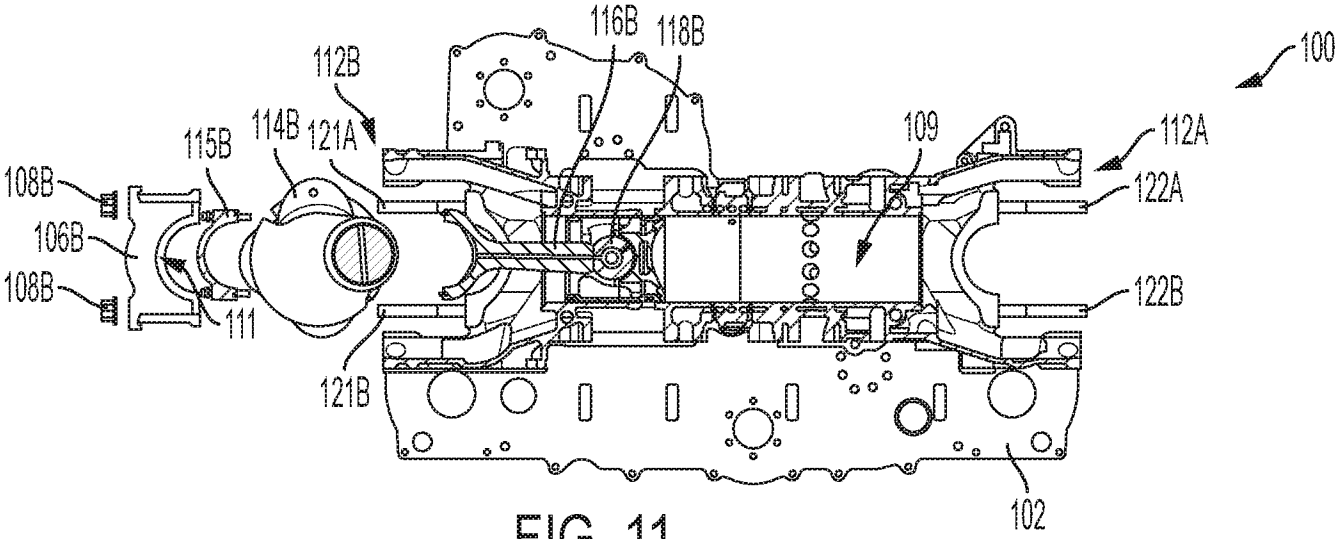
FIG. 11 is an exploded, side view of the bearing cap stud assembly illustrating an assembly step to assemble the bearing cap stud assembly within the base block.
Figure 12:
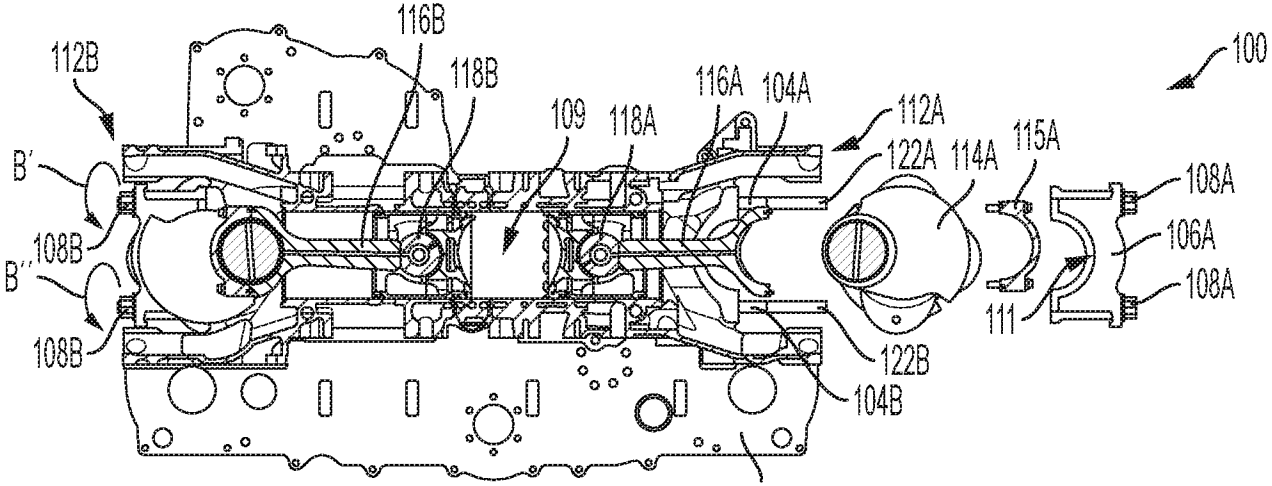
FIG. 12 is an exploded, side view of the bearing cap stud assembly illustrating another assembly step to assemble the bearing cap stud assembly within the base block.
Figure 13:
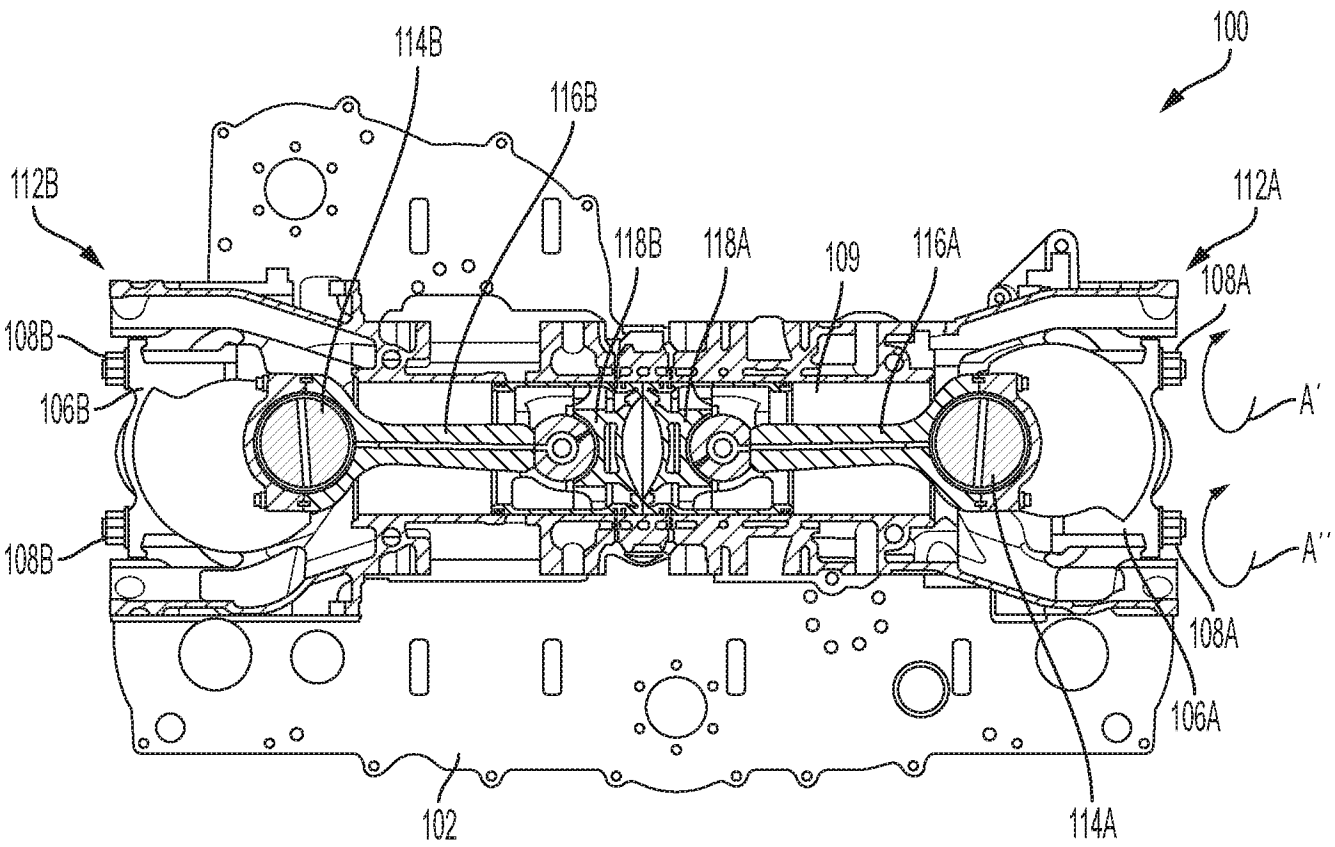
FIG. 13 is an exploded, side view of the bearing cap stud assembly illustrating another assembly step to assemble the bearing cap stud assembly within the base block.

Referring now to FIGS. 10-13, a method of assembling engine assembly 100 is illustratively shown. As shown in FIG. 10, stud assemblies 104A, 104B have been inserted within base block 102 (via passages 140A, 140B) such that a portion of stud assemblies 104A, 104B and fasteners 121 protrude into cavities 112A, 112B. Then, as shown in FIGS. 11 and 12, engine piston 118B, connecting rod 116B, crankshaft 114B, bearing cap 115B, and bearing cap 106B are fed through cavity 112B into passage 109 (FIGS. 1 and 11-13) such that engine piston 118B and connecting rod 116B are seated within passage 109 while crankshaft 114B is seated within recess 111 of bearing cap 106B, all of which are seated within cavity 112B. When installing bearing caps 106B, bearing caps 106B are seated onto protruding fasteners/ends (hex features) 121A, 121B by a mallet (not shown). As a result, as shown in FIG. 12, fasteners/ends (hex features) 121A, 121B of stud assemblies 104A, 104B engage with openings 107A, 107B (FIG. 5) of bearing cap 106B. Then, as further shown in FIG. 12, nuts 108B are coupled to the protruding fasteners/ends (hex features) 121A, B and partial torque is applied onto nuts 108B in the direction of B' and B" to partially tighten nuts 108B onto bearing caps 106B.

After this is completed, similar to FIG. 11, engine piston 118A, connecting rod 116A, crankshaft 114A, bearing cap 115A, and bearing cap 106A are fed through cavity 112A into passage 109 such that engine piston 118A and connecting rod 116A are seated within passage 109 while crankshaft 114A is seated within recess 111 of bearing cap 106A, all of which are seated within cavity 112A. When installing bearing caps 106A, bearing caps 106A are seated onto the protruding fasteners/ends (hex features) 122A, 122B by the mallet (not shown). As a result, as shown in FIG. 12, ends 121A, 121B of stud assemblies 104A, 104B engage with openings 105A, 105B of bearing cap 106A. Then, as further shown in FIG. 13, nuts 108A are coupled to the protruding fasteners 122A, B, and full torque is applied onto nuts 108A in the direction of A' and A" to fully tighten nuts 108A onto bearing caps 106A such that bearing caps 106A engage with crankshaft 114A, and crankshaft 114A is held in place.

Then, additional torque is applied onto nuts 108B in the direction of B' and B" (FIG. 13) to fully tighten nuts 108B such that bearing caps 108A engage with crankshaft 114B, and crankshaft 114B is held in place.

Advantageously, this method of assembly permits assembly of full-length stud assemblies 104 within base block 102 without compromising optimum load carrying characteristics of the design. In addition, prior installations required a full length cross stud with a fixed head or nut installed needed enough clearance to install or retract the entire length of the stud within the base block, and fixtures were needed to hold the first crankshaft in place while the second crankshaft and main bearing cap nuts were installed and torqued. By contrast, the configuration of the present disclosure eliminates the need to use auxiliary fixtures to hold components in place (first installed crankshaft on one side) while installing the second crankshaft on the opposite side of the base block.

Furthermore, the configuration of stud assemblies 104 and base block 102 and their subsequent engagement allow stud assemblies 104 to be supported at midspan of stud assemblies 104 to prevent several modes of vibration and fretting during installation and engine operation.

While the above assembly/installation method describes the assembly as beginning with the installation of engine components on the "B" side of base block 102, it is contemplate that in alternate embodiments, the assembly method begins with the installation of engine components on the "A" side of base block 102.

While the invention has been described by reference to various specific embodiments it should be understood that numerous changes may be made within the spirit and scope of the inventive concepts described, accordingly, it is intended that the invention not be limited to the described embodiments but will have full scope defined by the language of the following claims.

What is claimed is:

1. An engine assembly comprising:

a base block including a first cavity configured to receive a first crankshaft and a second cavity configured to receive a second crankshaft;

a stud assembly receivable through the base block, the stud assembly including:

a sleeve encircling the stud assembly, the sleeve configured to create a cooling annulus for the stud assembly; and a first ring encircling the stud assembly, the first ring configured to retain the stud assembly onto the base block by engaging with a groove in the base block.

2. The engine assembly of claim 1, further including a second ring coupling the sleeve onto the stud assembly.

3. The engine assembly of claim 1, further including a first bearing cap coupled to a first end of the stud assembly and a second bearing cap coupled to a second end of the stud assembly.

4. The engine assembly of claim 3, further including a first nut coupling the first bearing cap to the stud assembly and a second nut coupling the second bearing cap to the stud assembly.

5. The engine assembly of claim 4, wherein the base block receives a first connecting rod and a first piston coupled to the first crankshaft and a second connecting rod and a second piston coupled to the second crankshaft.

6. The engine assembly of claim 4, wherein the base block receives a first connecting rod and a first piston coupled to the first crankshaft and a second connecting rod and a second piston coupled to the second crankshaft.

7. The engine assembly of claim 1, wherein the stud assembly includes a first end and a second end, the first end and second end having a hexagonal shape and configured to couple to a first bearing cap and a second bearing cap, respectively.

8. The engine assembly of claim 1, wherein the cooling annulus is formed within the base block when the stud assembly is inserted into the base block, the cooling annulus configured to allow coolant flow therethrough.

9. The engine assembly of claim 8, wherein the first piston and the second piston are in an opposed configuration.

* * * * *